US007712892B2

(12) United States Patent
Nishida et al.

(10) Patent No.: US 7,712,892 B2
(45) Date of Patent: May 11, 2010

(54) IMAGE FORMING APPARATUS

(75) Inventors: Hajime Nishida, Kanagawa (JP); Manabu Nonaka, Kanagawa (JP); Eiki Yoshimizu, Kanagawa (JP); Shinichiro Naruse, Kanagawa (JP); Yasuhiro Kawashima, Kanagawa (JP); Hideki Sueoka, Tokyo (JP); Tetsu Morino, Kanagawa (JP); Kazumasa Ishikawa, Kanagawa (JP); Yasunobu Youda, Kanagawa (JP); Akihiro Fujita, Kanagawa (JP); Shoji Asanuma, Kanagawa (JP); Masatoshi Sakakitani, Kanagawa (JP); Taku Kudoh, Kanagawa (JP); Shigeyuki Ito, Aichi (JP); Yohzoh Dohki, Aichi (JP); Koji Watanabe, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 432 days.

(21) Appl. No.: 11/068,833

(22) Filed: Mar. 2, 2005

(65) Prior Publication Data

US 2005/0194730 A1 Sep. 8, 2005

(30) Foreign Application Priority Data

Mar. 3, 2004 (JP) ..... 2004-058289

(51) Int. Cl.
*B41J 2/01* (2006.01)

(52) U.S. Cl. ..... 347/104; 347/101

(58) Field of Classification Search ..... 347/104, 347/101; 346/134; 399/361; 400/578
See application file for complete search history.

(56) References Cited

U.S. PATENT DOCUMENTS

| | | | | | |
|---|---|---|---|---|---|
| 4,244,465 | A * | 1/1981 | Hishikawa et al. | ..... | 198/691 |
| 5,444,468 | A * | 8/1995 | Fukushima et al. | ..... | 347/14 |
| 5,668,581 | A * | 9/1997 | Tsuji et al. | ..... | 347/37 |
| 5,757,407 | A * | 5/1998 | Rezanka | ..... | 347/102 |
| 5,808,647 | A * | 9/1998 | Kurata et al. | ..... | 347/104 |
| 5,821,968 | A * | 10/1998 | Ohyama et al. | ..... | 347/104 |
| 5,847,719 | A * | 12/1998 | Yamaguchi et al. | ..... | 346/134 |
| 5,874,979 | A * | 2/1999 | Ohyama | ..... | 347/104 |
| 5,943,081 | A * | 8/1999 | Uchida et al. | ..... | 347/104 |
| 6,097,408 | A * | 8/2000 | Fukushima et al. | ..... | 347/34 |
| 6,179,419 | B1 * | 1/2001 | Rasmussen et al. | ..... | 347/104 |
| 6,309,064 | B1 * | 10/2001 | Tanno et al. | ..... | 347/104 |
| 7,384,042 | B2 * | 6/2008 | Sakakibara et al. | ..... | 271/270 |
| 7,404,618 | B2 * | 7/2008 | Lim et al. | ..... | 347/33 |

(Continued)

FOREIGN PATENT DOCUMENTS

CN 1383057 A 12/2002

(Continued)

OTHER PUBLICATIONS

U.S. Appl. No. 12/263,124, filed Oct. 31, 2008 Fujita.

*Primary Examiner*—Manish S Shah
*Assistant Examiner*—Leonard S Liang
(74) *Attorney, Agent, or Firm*—Oblon, Spivak, McClelland, Maier & Neustadt, L.L.P.

(57) ABSTRACT

An inkjet recording apparatus provides an improved printing speed and improved convenience of use. A recording head discharges droplets of a recording liquid onto a paper so as to form an image on the paper. A belt conveyance mechanism has a belt onto which the paper is electrostatically attached. The paper attached onto the belt is conveyed in a direction perpendicular to a carding direction of the paper.

7 Claims, 11 Drawing Sheets

U.S. PATENT DOCUMENTS

| | | | | |
|---|---|---|---|---|
| 7,431,278 | B2 * | 10/2008 | Hiraki et al. | 271/3.14 |
| 2002/0158953 | A1 * | 10/2002 | Matsui | 347/101 |
| 2002/0159091 | A1 | 10/2002 | Sakura | |
| 2003/0048345 | A1 * | 3/2003 | Matsumoto | 347/104 |
| 2003/0063175 | A1 * | 4/2003 | Nishikawa | 347/104 |
| 2003/0210315 | A1 * | 11/2003 | Uwagaki et al. | 347/104 |
| 2005/0024464 | A1 * | 2/2005 | Takagi | 347/104 |
| 2006/0055754 | A1 * | 3/2006 | Sakuma et al. | 347/101 |
| 2006/0164491 | A1 * | 7/2006 | Sakuma et al. | 347/104 |

FOREIGN PATENT DOCUMENTS

| | | |
|---|---|---|
| JP | 7-53081 | 2/1995 |
| JP | 9-183546 | 7/1997 |
| JP | 9-183547 | 7/1997 |
| JP | 9-222801 | 8/1997 |
| JP | 10-10878 | 1/1998 |
| JP | 10-138587 | 5/1998 |
| JP | 2897960 | 3/1999 |
| JP | 2000-168987 | 6/2000 |
| JP | 2000-203739 | 7/2000 |
| JP | 2000-247476 | 9/2000 |
| JP | 2000-272770 | 10/2000 |
| JP | 2003-103857 | 4/2003 |

* cited by examiner

IMAGE FORMING APPARATUS

BACKGROUND OF THE INVENTION

1. Field of the Invention

The present invention generally relates to image forming apparatuses and, more particularly, to an image forming apparatus that is capable of forming an image by a recording liquid while conveying a paper in a transverse direction.

2. Description of the Related Art

Inkjet recording apparatuses are known as image forming apparatuses incorporated in a printer, a facsimile machine, a copy machine and a combination machine of a printer, a facsimile machine and a copy machine that perform image formation (recording, printing and copying may be used as equivalent words) by causing droplets of a recording liquid (hereinafter, may be referred to as ink droplets) to adhere onto a paper, while conveying the paper, using a recording head (image forming means) constituted by a liquid droplet discharge head which discharges droplets of a recording liquid.

As the liquid droplet discharge head, there are used a piezoelectric type using an electromechanical transducer such as a piezoelectric element, a thermal type which generated bubbles by film boiling of ink using an electrothermal transducer such as a heating resistor provided in a discharge chamber, and an electrostatic type which discharges ink droplets by deforming by an electrostatic force a diaphragm forming a wall of a discharge chamber.

In the meantime, since ink is caused to adhere onto a paper according to an inkjet recording method, there occurs a phenomenon that the paper extends due to a water component contained in ink when image is formed on the paper. This phenomenon is referred to as cockling. When the cockling occurs, the paper is waved, which results in changes in a position of the paper surface and a nozzle plane of the head location to location. If a degree of cockling increases, in a worst case, the paper is brought into contact with the nozzle plane of the head, which causes contamination of the nozzle plane of the head and contamination of the paper itself. Additionally, landing positions of the ink droplets may be offset due to influence of the cockling.

By the way, in a conventional inkjet recording apparatus, for example, as shown in FIG. 1, a convey roller 601 and a press roller 602 are located on an upstream side and a paper eject roller 604 and a spur 603 are located on a downstream side with a printing area by an inkjet head 600 located therebetween, and a second paper eject roller 606 and a second spur 605 are located on a downstream side of the paper eject roller 604 and the spur 603, and, further, a guide member 507 is located in the printing area so as to guide the paper so as to perform conveyance by two sets of the roller pair.

In this case, since there is a demand for increasing the image forming area, in order to acquire a large printing area, there exist an inkjet recording apparatus that performs printing in a state where an accuracy of feed of a paper cannot be guaranteed, that is, in a state where a paper is engaged with only one pair of rollers. However, in the state where a paper is engaged with only one pair of rollers, if a paper lift occurs, an accuracy of feed cannot guaranteed since there is no measures to solve the paper lift or a force to convey the paper cannot be acquired, and, thus, there is a problem in that an image quality deteriorates.

Additionally, as disclosed in Japanese Patent Publication No. 2897960 and Japanese Laid-Open Patent Applications No. 7-53081 and No. 2003-103857, there is suggested an inkjet recording apparatus having an endless charge belt that is capable of maintaining excellent flatness by preventing a paper from being lifted from the charge belt by conveying the paper by rotating the charge belt in a state where the paper is electrostatically attracted to the charge belt of which surface is electrically charged.

Additionally, although it is an image forming apparatus using an electrophotography, as disclosed in Japanese Laid Open Patent Application No. 10-10878, there are known a corona discharge type, an endless belt type and a separation claw type as a separation system for separating a transfer material electrostatically attached to a conveyor.

Further, as disclosed in Japanese Laid-Open Patent Application No. 10-138587, it is known that a paper after image formation is pressed by a spur when it is ejected in an inkjet recording apparatus.

By the way, generally, there is a carding mesh in a paper, and the carding direction coincides with a longitudinal direction of the paper. If a such a paper having a carding mesh is conveyed in a direction in which the carding direction is perpendicular to a conveying direction, the nozzle plane and the paper may contact with each other since the paper bends largely in a direction along the conveying direction due to cockling caused by adhesion of liquid droplets as mentioned above, which results in a problem peculiar to an inkjet recording apparatus that an image failure occurs.

That is, in a case where a longitudinal mesh direction conveyance is performed in which the carding direction of the paper 500B coincides with the conveying direction as shown in FIG. 2A, if cockling occurs in the paper, the paper merely waves in a direction (main-scanning direction) perpendicular to the conveying direction as shown in FIG. 2B. Thus, an amount of waving as a whole is relatively small, and, thereby, the paper 500B is prevented from being brought into contact with a nozzle plane of a head 600.

On the other hand, in a case where a transverse mesh direction conveyance is performed in which the carding direction of the paper 500A is perpendicular to the conveying direction as shown in FIG. 3A, the paper 500A is lifted in a curled shape due to cockling as shown in FIG. 15B or FIG. 1, and, thus, there is an extremely high possibility that the paper is brought into contact with the nozzle plane of the head 600.

Therefore, in the conventional inkjet recording apparatus, only the setting of papers causing the longitudinal mesh direction conveyance is permitted, and the setting causing the transverse mesh direction conveyance is prohibited so that the transverse mesh direction conveyance is not performed. For example, papers of A4 size are used, only the setting causing the longitudinal direction of A4 size to be a conveying direction is permitted, and the setting causing the transverse direction of A4 size to be the conveying direction is prohibited. The above-mentioned problem does not occur in an electrophotography image forming apparatus using no recording liquid.

However, it has been demanded for an inkjet recording apparatus to be capable of handling large size papers, and is required for the inkjet recording apparatus to use not only A4 size papers as in conventional apparatus but also A3 size papers. In such a case, since the shorter side width of A3 size is equal to the longer side width of A4 size, it is convenient for a user if the A4 size papers can be set in either the longitudinal mesh direction conveyance or the transverse mesh direction conveyance.

Moreover, in the case of an inkjet recording apparatus, a printing speed can be increased as a number of times of feed in a sub-scanning direction is decreased, that is, an area, which is printed by a single sub-scanning, is increased. Thus, if A4 size papers are used, the printing speed for the transverse mesh direction conveyance can be higher than that for the longitudinal mesh direction conveyance.

However, in the conventional inkjet recording apparatus, there is a problem that papers are not permitted to be conveyed in the transverse mesh direction due to the problem of cockling peculiar to the inkjet recording as mentioned above.

SUMMARY OF THE INVENTION

It is a general object of the present invention to provide an improved and useful image forming apparatus in which the above-mentioned problems are eliminated.

A more specific object of the present invention is to provide an image forming apparatus which improves a printing speed and convenience of use.

In order to achieve the above-mentioned objects, there is provided according to the present invention an image forming apparatus comprising: a recording head that discharges droplets of a recording liquid onto a paper so as to form an image; and a belt conveyance mechanism that electrostatically attaches the paper and conveys the paper in a direction perpendicular to a carding direction of the paper.

According to the present invention, since the image forming apparatus has the belt conveyance mechanism that electrostatically attaches the paper and conveys the paper in a direction perpendicular to a carding direction of the paper, the paper can be subjected to a recording operation while being conveyed in a transverse mesh direction, which improves a printing speed and also improves convenience of use.

The image forming apparatus according to the present invention may further comprise a separating mechanism that separates the paper from the belt conveyance mechanism. The separating mechanism may include a separating member that is brought into contact with the paper being fed out of the belt conveyance mechanism.

The image forming apparatus according to the present invention may further comprise a lift preventing mechanism that prevents a lift of the paper being fed out of the belt conveyance mechanism. The lift preventing mechanism may include a contacting member that is brought into contact with the paper being fed out of the belt conveyance mechanism, and the contacting member may be located on an upstream side of a separation point at which the paper is separated from the belt conveyance mechanism. The lift preventing mechanism may includes a contacting member that is brought into contact with the paper being fed out of the belt conveyance mechanism, and the contacting member may be movable in a direction substantially perpendicular to a direction of conveyance of the paper.

Additionally, the image forming apparatus according to the present invention as claimed in claim 1, further comprising: a separating mechanism that separates the paper from the belt conveyance mechanism; and a lift preventing mechanism that prevents a lift of the paper being fed out of the belt conveyance mechanism. The separating mechanism may include a separating member that is brought into contact with the paper being fed out of the belt conveyance mechanism. The lift preventing mechanism may include a contacting member that is brought into contact with the paper being fed out of the belt conveyance mechanism, and the contacting member may be located on an upstream side of a separation point at which the paper is separated from the belt conveyance mechanism. The lift preventing mechanism may include a contacting member that is brought into contact with the paper being fed out of the belt conveyance mechanism, and the contacting member may be movable in a direction substantially perpendicular to a direction of conveyance of the paper.

Additionally, the separating mechanism and the lift preventing mechanism may be located along the same line perpendicular to a direction of conveyance of the paper by the belt conveyance mechanism. The separating mechanism and the lift preventing mechanism may be arranged alternately in the direction perpendicular to the direction of conveyance of the paper. The lift preventing mechanism may include a contacting member that is brought into contact with the paper being fed out of the belt conveyance mechanism, and the contacting member may be movable in a direction substantially perpendicular to a direction of conveyance of the paper.

Additionally, the image forming apparatus according to the present invention may further comprise a paper supply mechanism that accommodates the paper to be supplied to the belt conveyance mechanism so that paper is set in the paper supply mechanism in a state where a carding direction of the paper is perpendicular to a direction of conveyance of the paper by the belt conveyance mechanism. The paper supply mechanism may be configured and arranged to permit an insertion of the paper so that a direction of the insertion of the paper coincides with a carding direction of the paper.

According to the above-mentioned invention, since the image forming apparatus has the belt conveyance mechanism that electrostatically attaches the paper and conveys the paper in a direction perpendicular to a carding direction of the paper and also has a paper supply mechanism that accommodates the paper to be supplied to the belt conveyance mechanism so that paper is set in the paper supply mechanism in a state where a carding direction of the paper is perpendicular to a direction of conveyance of the paper by the belt conveyance mechanism, the paper can be subjected to a recording operation while being conveyed in a transverse mesh direction, which improves a printing speed and also improves convenience of use and further the paper can be set from the front side of the image forming apparatus, which further improves convenience of use of the image forming apparatus.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to FIGS. 4 through 10, of an image forming apparatus according to a first embodiment of the present invention.

Figure 4:
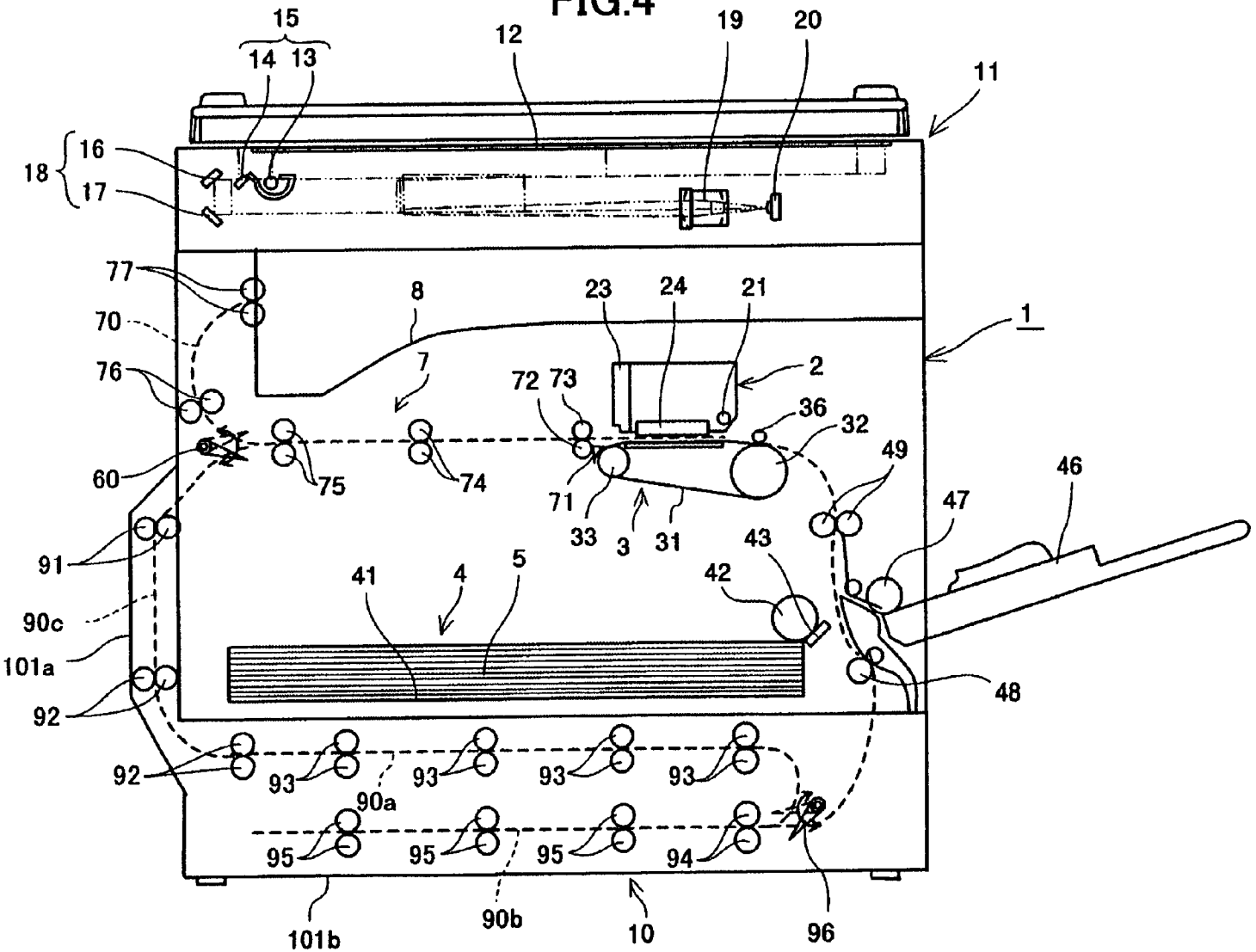
FIG. 4 is a side view of an image forming apparatus according to a first embodiment of the present invention showing an outline of the entire structure.
Figure 5:
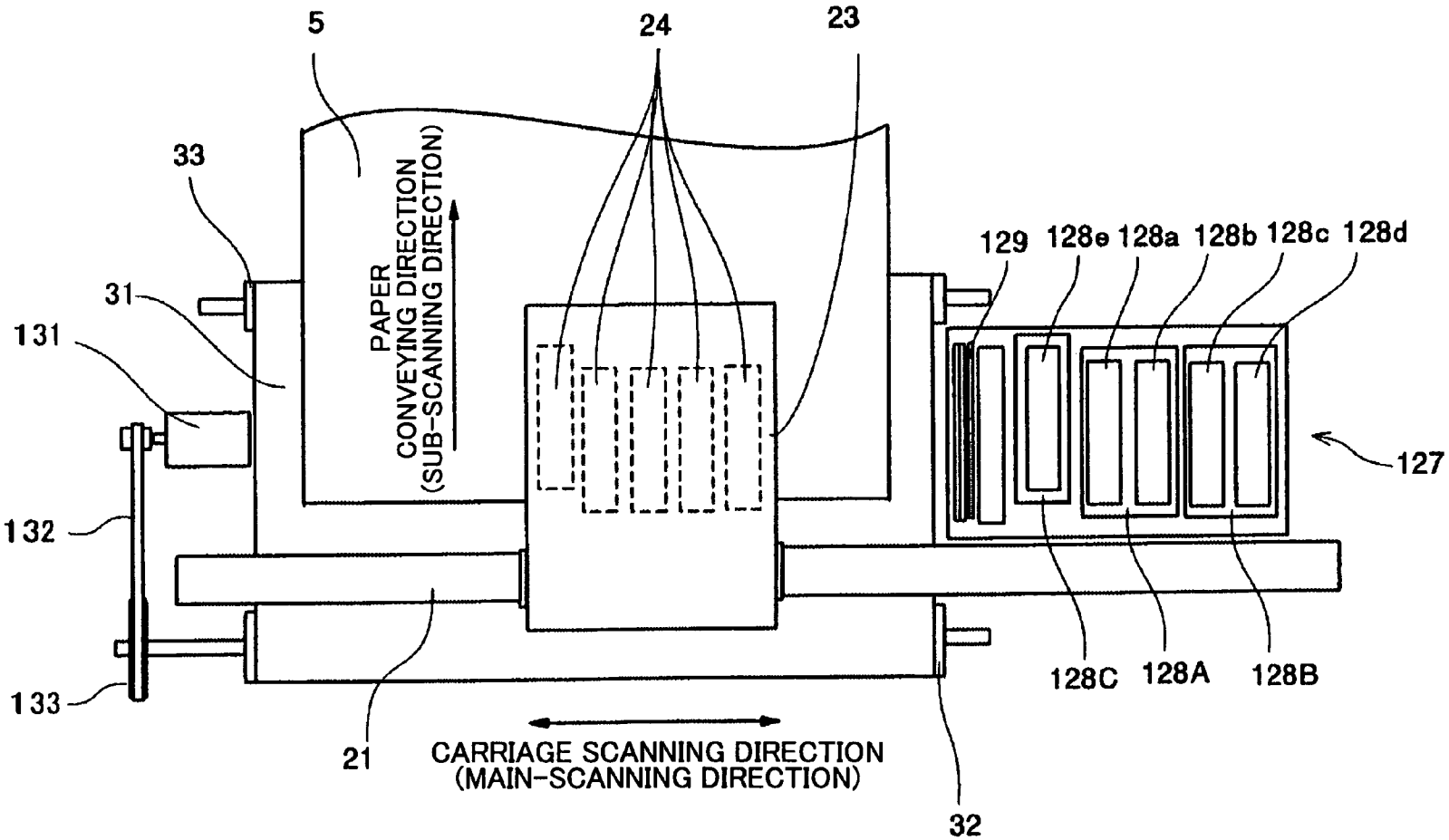
FIG. 5 is a plan view of an image forming part and a sub-scanning conveyance part in the image forming apparatus shown in FIG. 4.
Figure 6:
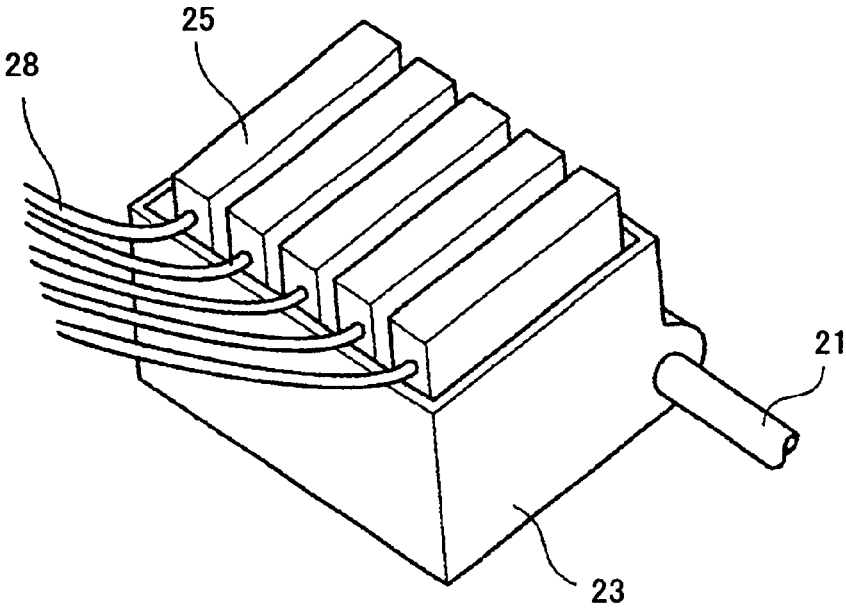
FIG. 6 is a perspective view of a carriage part of the image forming apparatus shown in FIG. 4.
Figure 7:
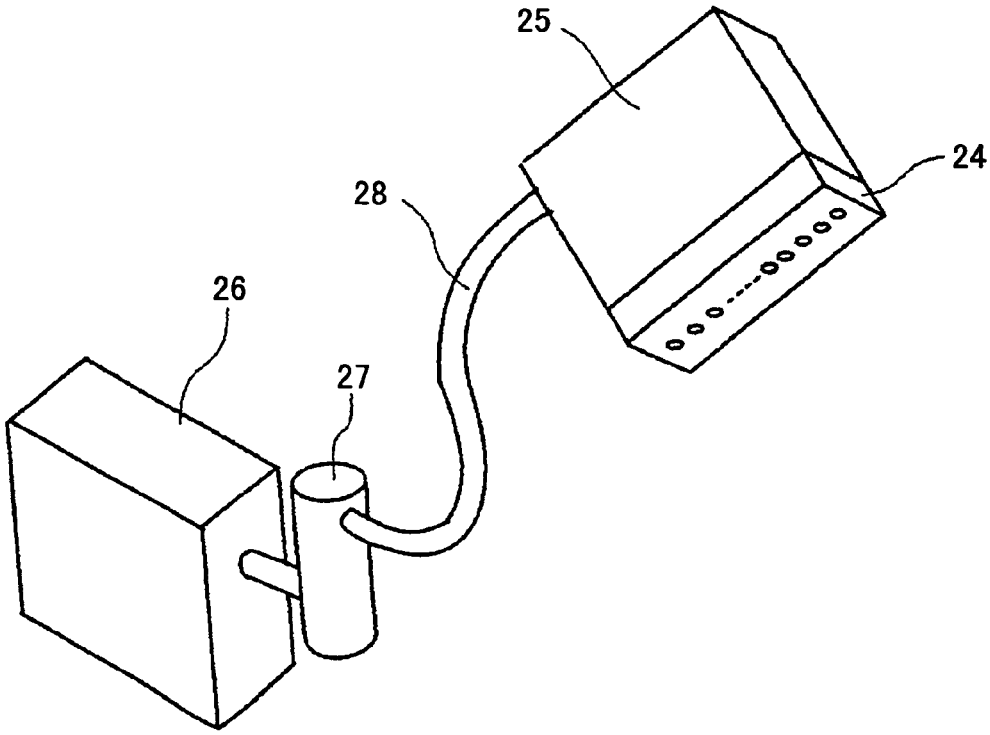
FIG. 7 is a perspective view of an ink supply system to a head of the image forming apparatus shown in FIG. 4.
Figure 8:
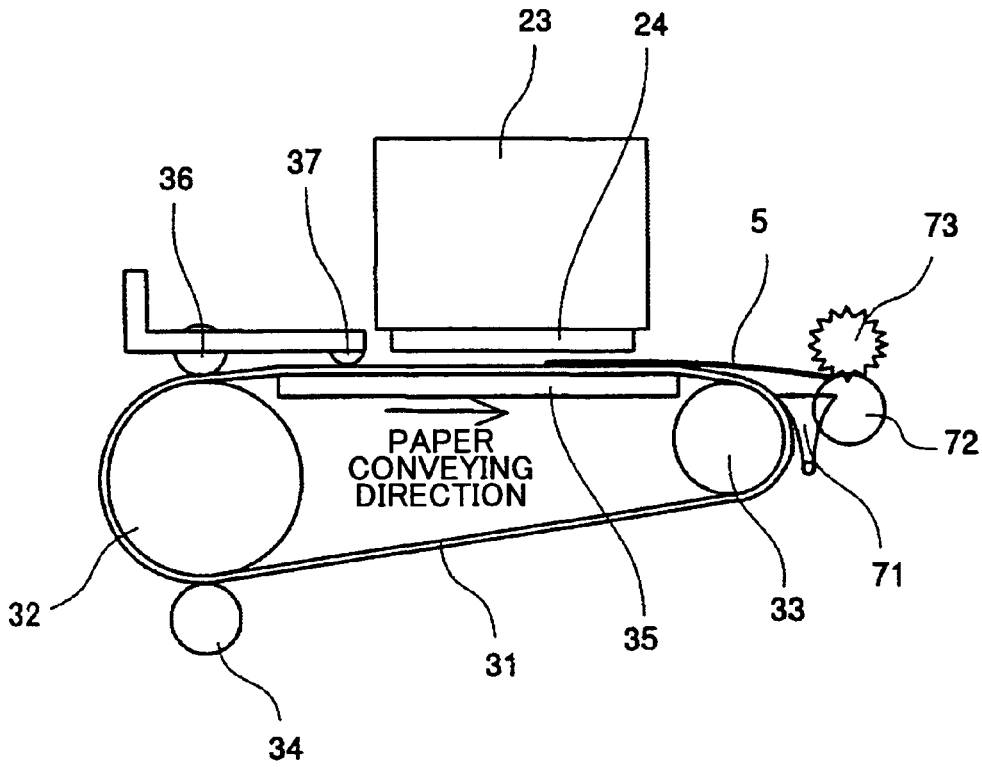
FIG. 8 is a side view of a part of a paper eject conveyance part and the sub-scanning conveyance part of the image forming apparatus shown in FIG. 4.
Figure 9:
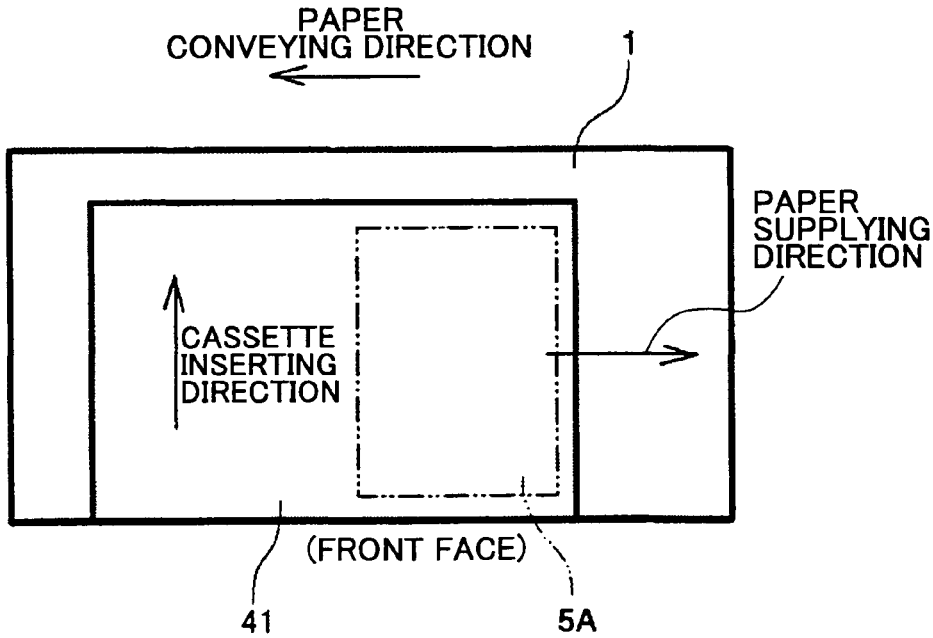
FIG. 9 is an illustration for explaining a paper supply cassette and a setting direction of papers.
Figure 10:
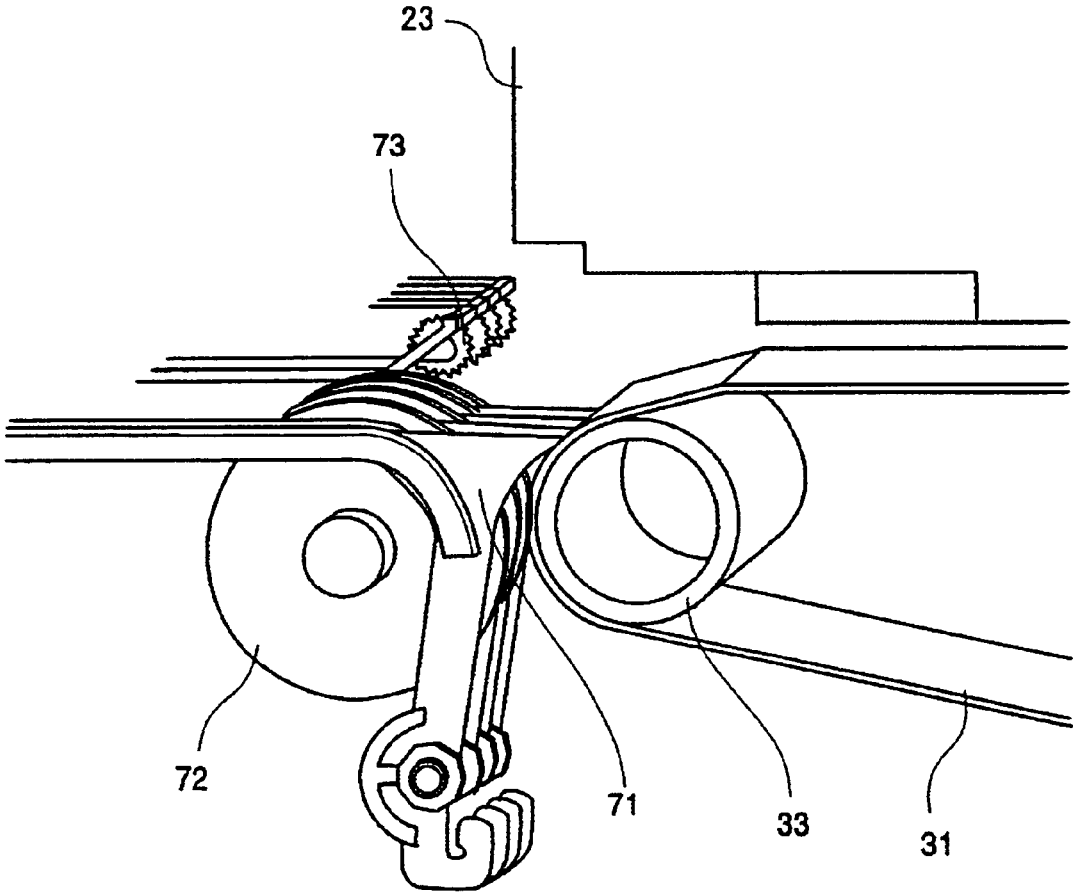
FIG. 10 is a perspective view of a part of the paper eject conveyance part of the image forming apparatus shown in FIG. 4.

FIG. 4 is a side view of the image forming apparatus according to the first embodiment of the present invention shown in an outline of the entire structure. FIG. 5 is a plan view of an image forming part and a sub-scanning conveyance part in the image forming apparatus shown in FIG. 4. FIG. 6 is a perspective view of a carriage part of the image forming apparatus shown in FIG. 4. FIG. 7 is a perspective view of an ink supply system to a head of the image forming apparatus shown in FIG. 4. FIG. 8 is a side view of a part of a paper eject conveyance part and the sub-scanning conveyance part of the image forming apparatus shown in FIG. 4. FIG. 9 is an illustration for explaining a paper supply cassette and a setting direction of papers. FIG. 10 is a perspective view of a part of the paper eject conveyance part of the image forming apparatus shown in FIG. 4.

The image forming apparatus shown in FIG. 4 comprises an apparatus body (housing) 1 and an image forming part (means) 2 for forming an image and a sub-scanning conveyance part (means) 3 for conveying papers. The image forming part 2 and the sub-scanning conveyance part 3 are accommodated in the apparatus body 1. A paper supply part (means) 4 provided in a bottom part of the apparatus body 1 feeds papers 5 one by one, and the paper 5 is conveyed by the sub-scanning conveyance part 3 at a position facing the image forming part 2. The image forming part 2 discharges liquid droplets toward the paper 5 while the paper 5 is being conveyed by the sub-scanning conveyance part 3 so as to form (record) a desired image. Thereafter, in a case of single-side printing, the paper 5 is ejected onto a paper eject tray 8 formed on an upper surface of the apparatus body 1 through a paper eject conveyance part (means) 7. In a case of both-side printing, the paper 5 is fed to a both-side unit 10 provided in a bottom part of the apparatus body 1 from a middle of the paper eject conveyance part 7 so as to perform a switch-back conveyance. Thus, the paper 5 is supplied to the sub-scanning conveyance part 3 again and an image is formed on the other side of the paper 5 and ejected onto the paper eject tray 8.

Additionally, the image forming apparatus is provided with an image reading part (scanner part) 11 for reading an image in an upper portion of the apparatus body 1 and above the paper eject tray. The image reading part 11 serves as an input system of image data (print data) used for forming an image in the image forming part 2. In the image reading part 11, a scanning optical system 15 including an illumination light source 13 and a mirror 14 and a scanning optical system 18 including mirrors 16 and 17 are moved so as to read an image of an original document placed on a contact glass 12. The scanned original document image is read as an image signal by an image reading element 20 arranged behind a lens 19. The read image signal is converted into a digital signal and is subjected to image processing, and, thereby, printing can be performed using the image processed print data.

Furthermore, the image forming apparatus is capable of receiving print data including image data from a host side through a network and printing the received print data after being processed. The image data included in the print data may be received from an input system of image data (print data) to be formed into an image by the image forming part 2, such as an image processing apparatus such as an external personal computer or the like, an image reading apparatus such as an image scanner or a picture taking apparatus such as a digital camera or the like.

Figure 1:
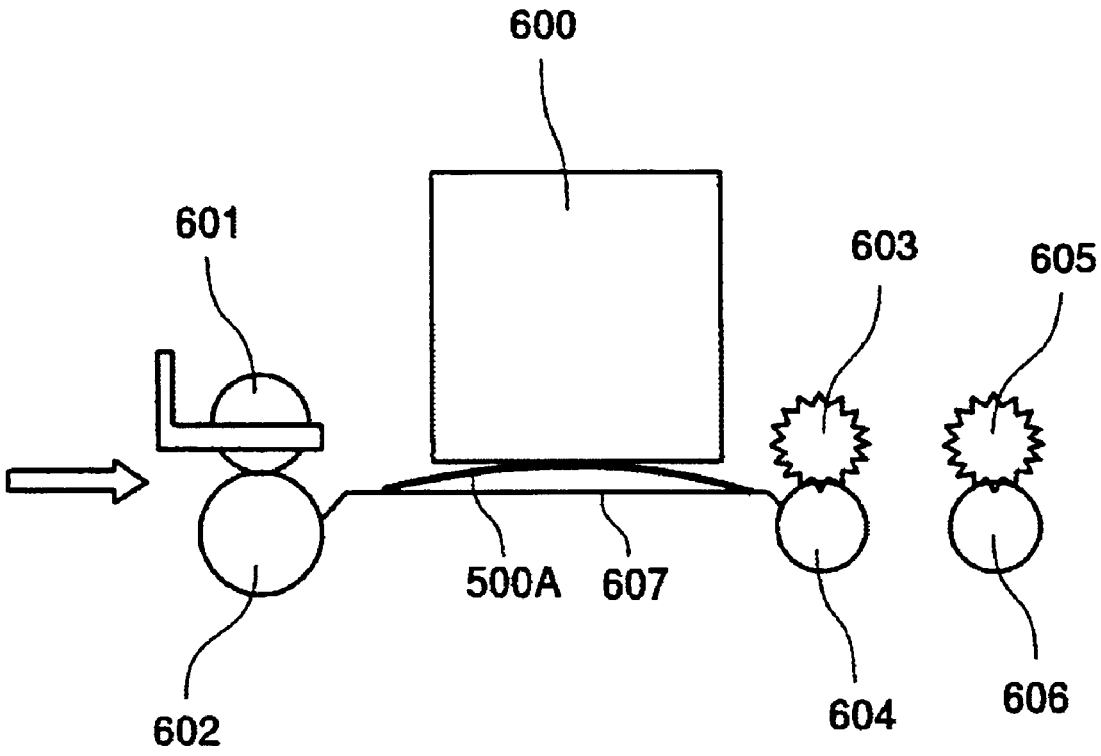
FIG.1 PRIOR ART
FIG. 1 is an illustration for explaining a sub-scanning conveyance part of a conventional roller conveyance system.
Figure 2A:
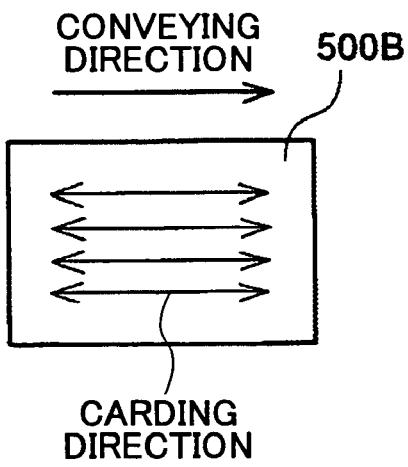
FIG.2A PRIOR ART
FIGS. 2A and 2B are illustrations for explaining a longitudinal mesh direction conveyance.
Figure 2B:
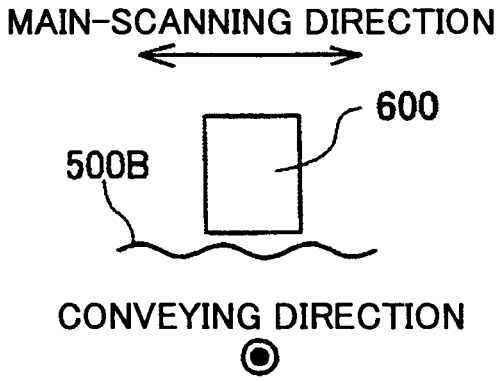
FIG.2B PRIOR ART
Figure 3A:
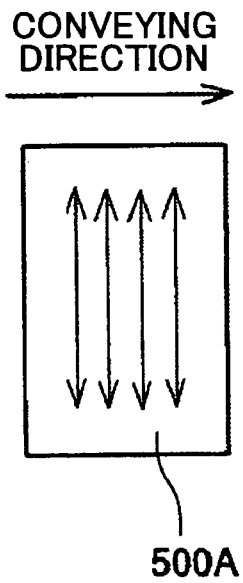
FIG.3A PRIOR ART
FIGS. 3A and 3B are illustrations for explaining a transverse mesh direction conveyance.
Figure 3B:
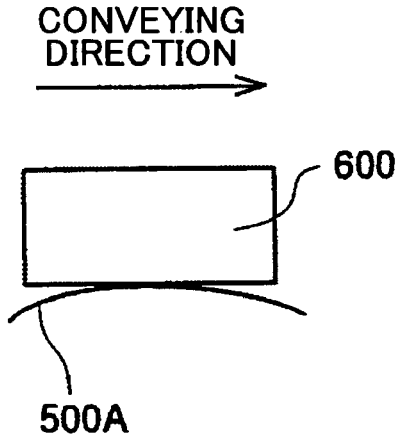
FIG.3B PRIOR ART

Here, the image forming part 2 of the image forming apparatus is of a shuttle type wherein, as also shown in FIG. 2, recording heads 24, each of which discharges liquid droplets of a respective color, are mounted on a carriage 23 movable in a main-scanning direction (a direction perpendicular to a paper conveying direction) by being guided by a carriage guide 21 so as to form an image by discharging liquid droplets from the recording heads 24 while feeding the paper 5 in the paper conveying direction (sub-scanning direction) by the sub-scanning conveyance part 3 by moving the carriage 23 in the main-scanning direction. It should be noted that the image forming part 2 may use a line type head.

The recording heads 24 is constituted by a total of five ink droplet discharge heads (hereinafter, may be simply referred to as a head) that includes tow liquid droplet discharge heads discharging black (Bk) ink and three liquid droplet discharge heads discharging cyan (C) ink, magenta (M) ink and yellow (Y) ink, respectively. Ink of each color is supplied from a sub-tank 25 mounted on the carriage 23 as shown in FIG. 6.

Each sub-tank 25 is supplied with ink from an ink cartridge 26 of a respective color, which is a main tank detachably attached in the apparatus body 1, by a pump 27 through a tube 28 as shown in FIG. 4. It should be noted that in addition to the recording heads 24 discharging ink droplets, a recording head may be provided, which discharges a fixing process liquid (fixing ink) which improves fixation of ink by reacting with the recording liquid (ink).

Moreover, as each recording head 24, a so-called piezo type, thermal type or an electrostatic type may be used. The piezo type uses a piezoelectric element serving as pressure-generating means (actuator means) for pressurizing ink in an ink flow passage (pressure-generating chamber) so as to discharge ink droplets by changing the volume of the ink flow passage by deforming a diaphragm defining a wall of the ink flow passage by driving the piezoelectric element. The thermal type uses a heating resistor so as to discharge ink droplets by a pressure by generating bubbles of ink by heating the ink within an ink flow passage. The electrostatic type uses an electrode facing a diaphragm defining a wall of an ink flow passage so as to discharge ink droplets by changing the volume of the ink flow passage by deforming the diaphragm by an electrostatic force generated between the diaphragm and the electrode.

Additionally, a maintenance and recovery mechanism (hereinafter, referred to as a subsystem) 127 is arranged in a non-printing area on one side of the scanning direction of the carriage 23. The subsystem 127 includes a cleaning device for maintaining or recovering a nozzle of each recoding head 24 in a good state. The subsystem 127 comprises cap members 128*a*, 128*b*, 128*c*, 128*d*, and 128*e* for capping nozzle planes of the respective recording heads 24 and a wiper blade 129 for wiping the nozzle planes. The cap members 128*a* and 128*b* are supported by a cap holder 128A, the cap members 128*c* and 128*d* are supported by a cap holder 128B, and the cap member 128*e* is supported by a cap holder 128C.

The sub-scanning conveyance part 3 serves as belt conveyance means for performing a transverse mesh direction conveyance that conveys the paper 5 in a direction perpendicular to the carding direction while electrostatically attracting the paper 5. The sub-scanning conveyance part 3 comprises, as shown in FIG. 8, an endless conveyance belt 31, which is engaged with an endless conveyance roller 32 as an drive roller and an idle roller (tension roller) 33, and a charge roller 34 for electrically charging the surface of the conveyance belt 31. The conveyance belt 31 conveys the paper 5, which is supplied from underneath, by turning the conveyance direction by about 90 degrees so as to convey the paper 5 in a position facing the image forming part 2. The charge roller 34 electrically charges the conveyance belt 31 by being applied with a high-voltage from a high-voltage power source s8 not shown in the figure).

Here, the belt conveyance mechanism (means) comprising the conveyance belt 31 and the charge roller 34 has a structure in which an electrostatic force is positively acquired so as to attract the paper 5 without being lifted above the surface of the belt even in a case where the paper 5, on which recording liquid adhere, is conveyed in the transverse mesh direction. This differs from the conventional structure in which only the longitudinal mesh direction conveyance is permitted while a conveyance belt and a charge roller are used.

Moreover, this sub-scanning conveyance part 3 comprises a guide member (platen) 35, a press roller 36 and a pressure roller 37. The guide member 35 guides the conveyance belt 31 in an area where the conveyance belt 31 faces the image forming part 2. The press roller presses the paper 5 against the conveyance belt 31 at a position facing the conveyance roller 32. The pressure roller 37 presses the paper 5 against the conveyance belt 31 at a position facing the platen 35 on an upstream side of the carriage 23.

The conveyance belt 31 of the sub-scanning conveyance part 3 is rotated in the belt conveyance direction (sub-scanning direction) shown in FIG. 5 by the conveyance roller 32 being rotated by a sub-scanning motor 131 via a timing belt 132 and a timing roller 133.

It should be noted that the conveyance belt 31 has a double layer structure including a front side layer serving as a paper attracting surface and a backside layer (an intermediate resistance layer or an earth layer). The front side layer is formed of, for example, a pure resin material, which is not subjected to a resistance control such as, for example, an ETFE pure material. The backside layer is formed of the same material with the front side layer but subjected to a resistance control by adding carbon.

The paper supply part 4 comprises a paper supply cassette 41, a paper feed roller 42 and friction pad 43. The paper supply cassette 41 is removably inserted from the front side of the apparatus body 1, and accommodates a large number of papers 5 in a stacked state. The paper feed roller 42 and the friction pad 43 feed the papers 5 by separating one by one.

Papers 5A, which are conveyed in the transverse mesh direction, can be set in the paper supply cassette 41. For example, papers of A4 size can be set in a position where the cassette inserting direction coincides with the longitudinal direction of the papers. Such setting of papers where the transverse direction conveyance is performed is not prohibited in the image forming apparatus according to the present embodiment.

Thus, by providing the cassette 41, as paper supply means, in which papers can be set in a position where the carding direction of the papers and the conveyance direction by the conveyance belt constituting the belt conveyance mechanism (means) are perpendicular to each other, the setting of papers in the transverse mesh conveyance direction in the paper supply cassette 41 is permitted, which improves convenience of use since the papers can be set in either a longitudinal mesh direction or a transverse mesh direction.

Then, by setting the inserting direction of the paper supply cassette 41 serving as the paper supply means to the same direction as the carding direction of the papers, a paper replenishing operation on the front side of the apparatus body 1 is permitted, which improves convenience of use. The paper supply part 4 comprises a manual insertion tray 46, a manual insertion roller 47, a conveyance roller 48 and a conveyance roller 49. The manual insertion tray accommodates papers 5 in a stacked state. The manual insertion roller 47 feeds the papers 5 from the manual insertion tray 46 one by one. The conveyance roller 48 conveys the paper 5 fed from a paper supply cassette attached as an option on under side of the apparatus body 1 or the both-side unit 10. The conveyance roller 49 feeds the supplied paper 5 into the sub-scanning conveyance part 3. It should be noted that even by paper supply by a manual insertion, the papers can be set at a position where the transverse mesh direction conveyance is performed.

The paper eject conveyance part 7 comprises, as shown in FIG. 8 and FIG. 10, a separation claw 71, a paper eject roller 72, a spur 73, and, as shown in FIG. 4, paper eject conveyance rollers 74, 75 and 76, and a paper eject roller 77. The separation claw 71 serves as a separating member of a separating mechanism (separating means) for separating the paper 5, which is conveyed by the conveyance belt 31 after image formation, from the conveyance belt 31. The paper eject roller 72 conveys the paper 5 by being brought into contact with the under side of the paper 5 separated. The spur 73 is arranged opposite to the paper eject roller 72. The paper eject conveyance rollers 74, 75 and 76 conveys the paper 5 fed out of a part between the paper eject roller 72 and the spur 73. The paper eject roller 77 feeds the paper 5 onto the paper eject tray 8. A paper eject conveyance path 70 is a conveyance path for ejecting the paper 5 onto the paper eject tray 8.

The both-side unit 10 comprises a vertical conveyance part 101*a* and a horizontal conveyance part 101*b*. The vertical conveyance part 101*a* forms a vertical both-side conveyance path 90*c* for receiving the paper 5, which is conveyed by being guided by a branch plate 60, from a side part of the apparatus body 1 and conveys the received paper 5 downward. The horizontal conveyance part 101*b* forms a horizontal taking conveyance path 90*a* for conveying the paper 5 subsequent to the vertical both-side conveyance path 90*c* and a switch-back conveyance path 90*b*.

The both-side conveyance path 90*c* is provided with a pair of both-side inlet rollers that conveys the paper 5 downward and a pair of conveyance rollers 92 that feeds the paper 5 to the horizontal taking conveyance path 90*a*. The horizontal taking conveyance path 90*a* has a pair of both-side conveyance rollers 93. The switch-back conveyance path 90*b* has a both-side outlet roller 94 and three pairs of both-side conveyance rollers 95. The both-side outlet roller 94 comprises a reverse roller for reversing the paper fed from the horizontal taking conveyance path 90*a*.

Additionally, there is provided a swingable branch plate 96, which switches between the conveyance path from the horizontal taking conveyance path 90*a* to the switch-back conveyance path 90*b* and a conveyance path for resupply of paper from the switch-back conveyance path 90*b* to the conveyance roller 48. The branch plate 96 is swingable between a switch-back side position indicated by solid lines in FIG. 4 and a paper resupply side position indicated by dashed lines in FIG. 4.

It should be noted that the branch plate 60 is swingable between a paper eject side position indicated by solid lines in FIG. 4 and a both-side side position indicated by dashed lines in FIG. 4 so as to switch the conveyance direction of the paper 5 to a direction toward the paper eject tray 8 and a direction toward the both-side conveyance unit 10. The branch plate 60 guides the paper 5 to the side of the pair of paper eject rollers 76 when positioned at the paper eject side position, and guides the paper 5 to a side of the pair of the both-side inlet rollers 91 when positioned at the both-side side position.

Moreover, although not illustrated, an image start sensor is provided on an upstream side of the image forming part 2 in the paper conveyance direction so as to detect a leading edge of the paper 5, and an image end sensor is provided on a downstream side of the image forming part 2 in the paper conveyance direction so as to detect a trailing edge of the paper 5.

Figure 11:
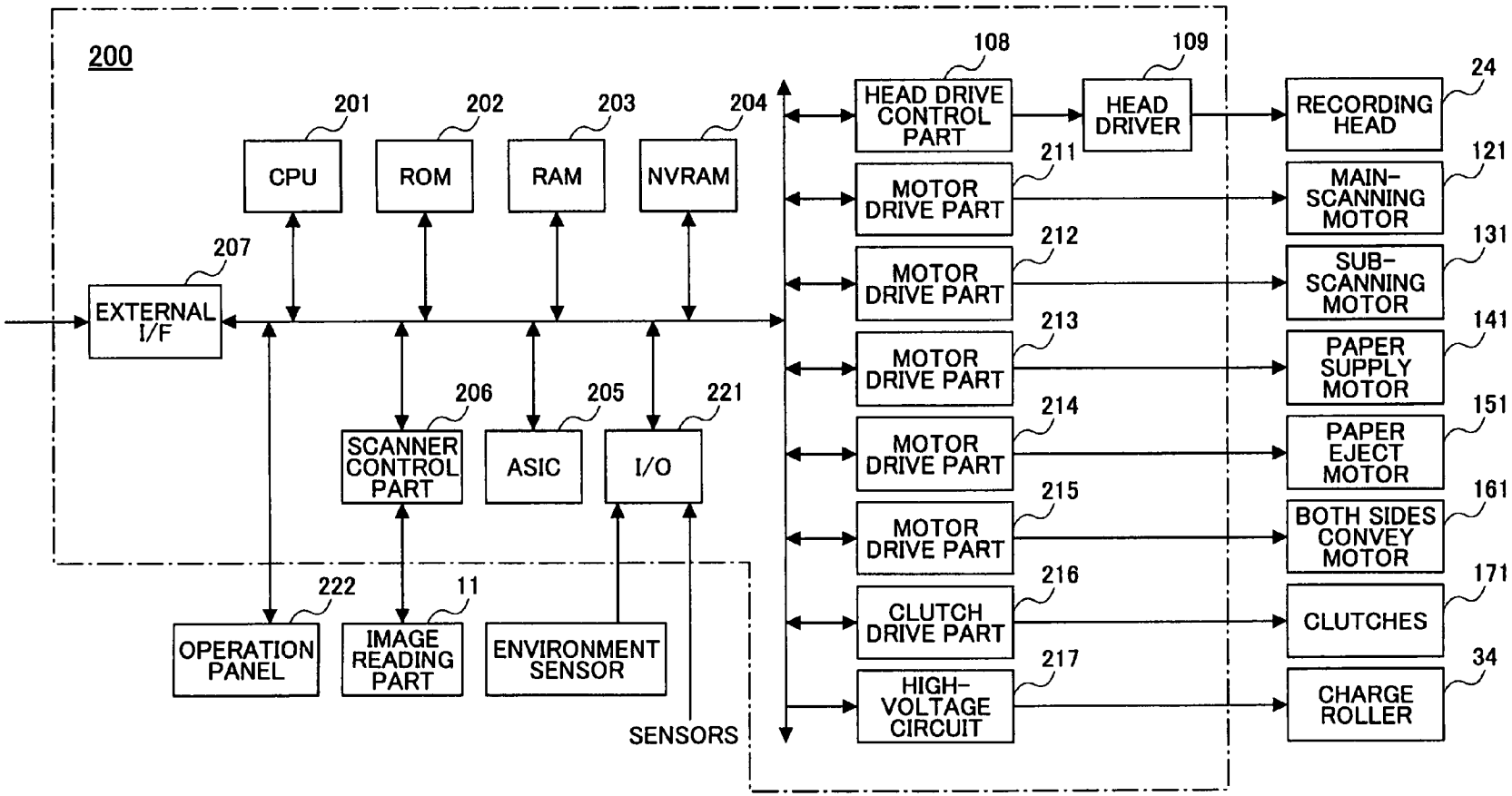
FIG. 11 is a block diagram of a control part of the image forming apparatus shown in FIG. 4.

A description will now be given, with reference to FIG. 11, of an outline of the control part of the image forming apparatus. It should be noted that FIG. 11 is a block diagram of the control part of the image forming apparatus. The control part 200 comprises: a CPU 201 controlling the entire image forming apparatus; a ROM 202 storing programs executed by the CPU 201 and other sets of fixed data; a RAM 203 temporarily storing image data (printing data) etc.; a non volatile memory (NVRAM) 204 retaining data while a power of the apparatus is turned off; an ASIC 205 performing image processing of various signal processes with respect to image data and input and output signal processing for controlling the entire apparatus; and a scanner control part 206 performing image reading by the image reading part 11 and performing data processing of the read image data.

The control part 200 further comprises: an I/F 207 for performing transmission and reception of data and signals which are used when receiving data from an external apparatus; a head drive control part 208 and a head driver 209 for controlling an operation of the recording head 21 of the image forming part 2; and motor drive parts 211 to 215 for driving various motors such as a main-scanning motor 121 for scanning the carriage 23 in the main-scanning direction, a sub-scanning motor 131 for rotating the conveyance roller 32 so as to rotate the conveyance belt 31, a paper supply motor 141, a paper eject motor 151, a both-side motor 161, etc. The control part 200 further comprises: a clutch drive part 216 for driving various clutches 171 such as a paper supply electromagnetic clutch 43; a branch plate solenoid which swingably displaces the branch plate 60 between the paper eject position and the both-side position, a branch solenoid which swingably displaces the branch plate 96 between the switch-back position and the paper resupply position. The control part 200 further comprises a high-voltage circuit 217 for applying a high-voltage to the charge roller 34.

Furthermore, the control part 200 comprises an I/O 221 for taking detection signals of various kinds of sensors such as the image start sensor and the image end sensor. An operation panel 222 is also connected to the control part 200 so as to input and display information necessary for the image forming apparatus.

When the control part reads an original document image by the image reading part 2, the control part 200 processes the read image and stores the processed read image in a buffer provided in the scanner control part 206. Additionally, when the control part receives print data through the external I/F 207 from an external host side such as an information processing apparatus such as a personal computer, an image reading apparatus such as an image scanner, an image taking apparatus such as a digital camera, the control part 200 stores the received print data in a buffer provided in the I/F 207.

Then, the CPU 201 reads and analyzes image data from the scanner control part 206 or the I/F 207, and performs a necessary image process and data arrangement by the ASIC 205, and, thereafter, transfer the processed print image data to the head drive control part 208. It should be noted that the generation of the dot pattern to be image output based on data from outside may be performed by, for example, storing font data in the ROM 202 or transferring image data to the image forming apparatus after developing the image data into bit map data by a printer driver on the external host side.

When the head drive control part 108 receives the image data (dot pattern data) equivalent to one line of each recording head 24, the head drive control part 108 transfers the dot pattern data equivalent to one line to the head driver 109. The head driver 109 drives the actuator means of the recording heads 24 by selectively applying necessary drive waveform in accordance with the dot pattern data, and, thereby, liquid droplets are discharged from necessary nozzles of the recording heads 24.

In the thus-constituted image forming apparatus, the papers 5 are fed one by one from the paper supply part 4 or the both-side unit 10, and pressed against the conveyance belt 131 by the press roller 36, and the conveyance direction is changed by about 90 degrees. Then, the paper 5 is electrostatically attracted by the conveyance belt 31 and is conveyed by rotational movement of the conveyance belt 31.

Then, one line is recorded by discharging ink droplets onto the stopped paper 5 by driving the recording heads 24 in accordance with image signals while moving the carriage 23. After finishing the recording of one line, the paper 5 is fed by one line, and a next line is recorded. In this way, an image is formed on the paper 5 while the paper 5 is intermittently conveyed. By receiving a recording end signal or a signal indicating that the trailing edge of the paper 5 has reached the recording area, the recording operation is ended and the paper 5 is fed onto the paper eject tray 8 or the both-side unit 10.

A description will now be given of a sub-scanning conveyance and a paper eject of the paper 5 in the image forming apparatus. The conveyance belt 31 is electrically charged in a predetermined pattern by being brought into contact with the charge roller 34 to which a high-voltage is applied while the conveyance belt 31 is rotated. In this case, the polarity of the charge roller 34 is switched at a predetermined time interval so that the conveyance belt 31 is charged with a predetermined charge pitch.

When the paper 5 is fed onto the high-potential charged conveyance belt 31, the paper 5 is set in a polarized state. Accordingly, a charge having polarity opposite to the charge on the conveyance belt 31 is induced on a surface of the paper 5 in contact with the conveyance belt 31. Thus, the charge on the conveyance belt 31 and the charge induced on the paper 5 being conveyed are attracted by each other, which results in that the paper 5 is electrostatically attached onto the conveyance belt 31. Thus, the paper 5 is firmly attached onto the conveyance belt 31, which corrects warp and unevenness of the paper and forms a highly flat surface of the paper 5.

Here, as mentioned above, an amount of charge of the conveyance belt 31 and the charge roller 34 is set so that the paper 5 is attached to the conveyance belt 31 with a strong attracting force even when the transverse mesh direction conveyance, in which the carding direction of the paper 5 is perpendicular to the conveyance direction, is performed.

Thus, the image formation can be done while the paper 5 is conveyed in the transverse mesh direction by which the carding direction of the paper 5 is perpendicular to the conveying direction, which improves a printing speed. Additionally, the paper 5 can be set in either the longitudinal direction or the transverse direction, which improves convenience of use.

A description will now be given of an action of the paper eject part 7. As mentioned above, when conveying the paper 5 by electrostatically attracting onto the conveyance belt 31 in the transverse mesh direction, the paper after image formation tends to be curled in the conveyance direction as mentioned above. Thereby, there is a possibility that the paper 5 is not separated from the conveyance belt 31 and is fed toward the charge roller 34 as the paper is continuously attached onto the conveyance belt 31.

Thus, in the image forming apparatus according to the present invention, the separation claw 71 as a separating member is provided for separating the paper 5 from the conveyance belt 31 so as to forcibly separate the paper form the conveyance belt 32. Thereby, the paper 5 is prevented from being not ejected and conveyed while being continuously attached on the conveyance belt 31.

A description will now be given, with reference to FIG. 12, of a second embodiment of the present invention. In the second embodiment, a spur 78 having a diameter smaller than a spur 73 opposite to the paper eject roller 72 above the separation claw 71. The spur 78 serves as a contacting member of a lift preventing mechanism (lift preventing means) for preventing a lift of the paper 5 being fed from the conveyance belt 31.

Figure 13:
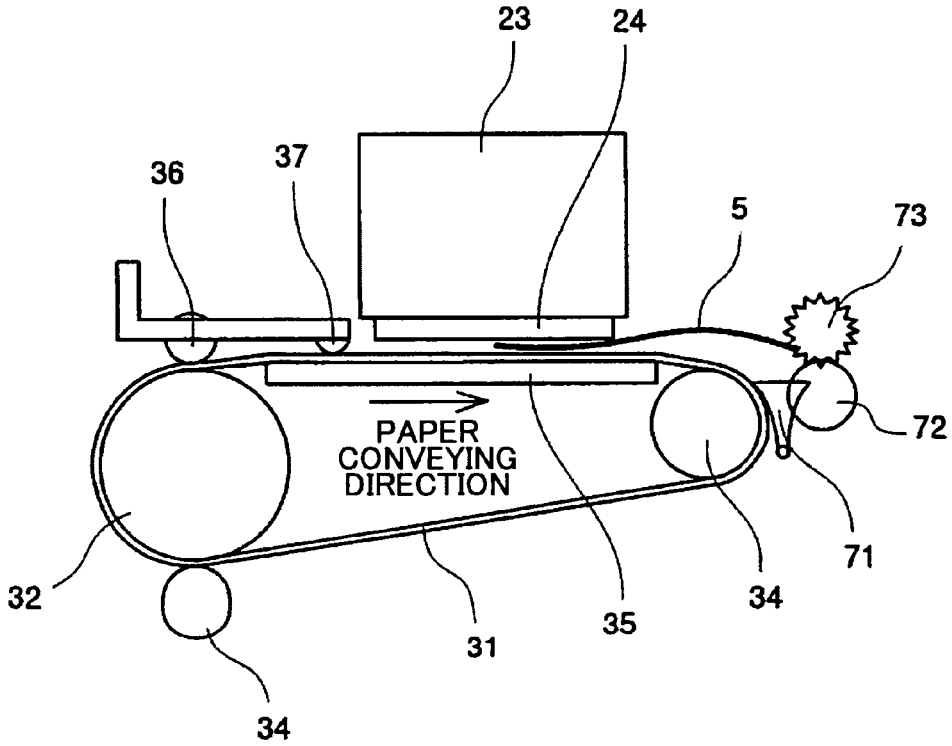
FIG. 13 a side view of the part of the image forming apparatus shown in FIG. 12 for explaining an effect of the second embodiment.

That is, although image formation can be performed by the transverse mesh direction conveyance in which the paper 5 is conveyed by the conveyance belt 31 in a direction perpendicular to the carding direction of the paper 5, when the paper 5 is separated from the conveyance belt 31, the paper 5 on which the recording liquid adhere may bend upward (lifted) due to the transverse mesh direction conveyance as shown in FIG. 13. It is observed experimentally that the above-mentioned phenomenon does not occur in the longitudinal mesh direction conveyance but occurs in the transverse mesh direction conveyance. If such a lift of the paper 5 occurs, the image forming surface of the paper 5 is brought into contact with the carriage 23 and rubbed by the carriage 23, which results in image failure.

Figure 12:
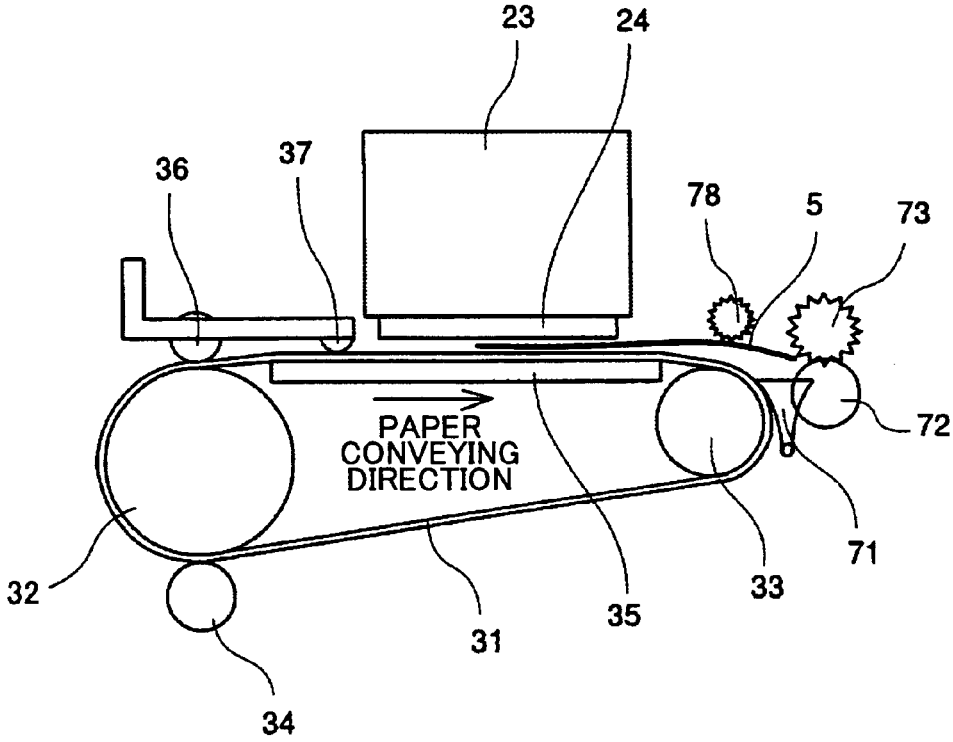
FIG. 12 is a side view of a part of an image forming apparatus according to a second embodiment of the present invention.

Thus, by providing the spur 78 as a lift preventing mechanism (lift preventing means), the spur 78 as a contacting member is brought into contact with the paper 5 if the paper 5 being fed out of the conveyance belt 31 tends to move upward, and the upward movement (a lift) of the paper 5 is reduced or prevented as shown in FIG. 12 so that the image forming surface of the paper 5 does no contact with the carriage 23 to eliminate image failure due to rubbing by the carriage 23. It should be noted that a flocculate mylar may be used instead of the spur.

Figure 14:
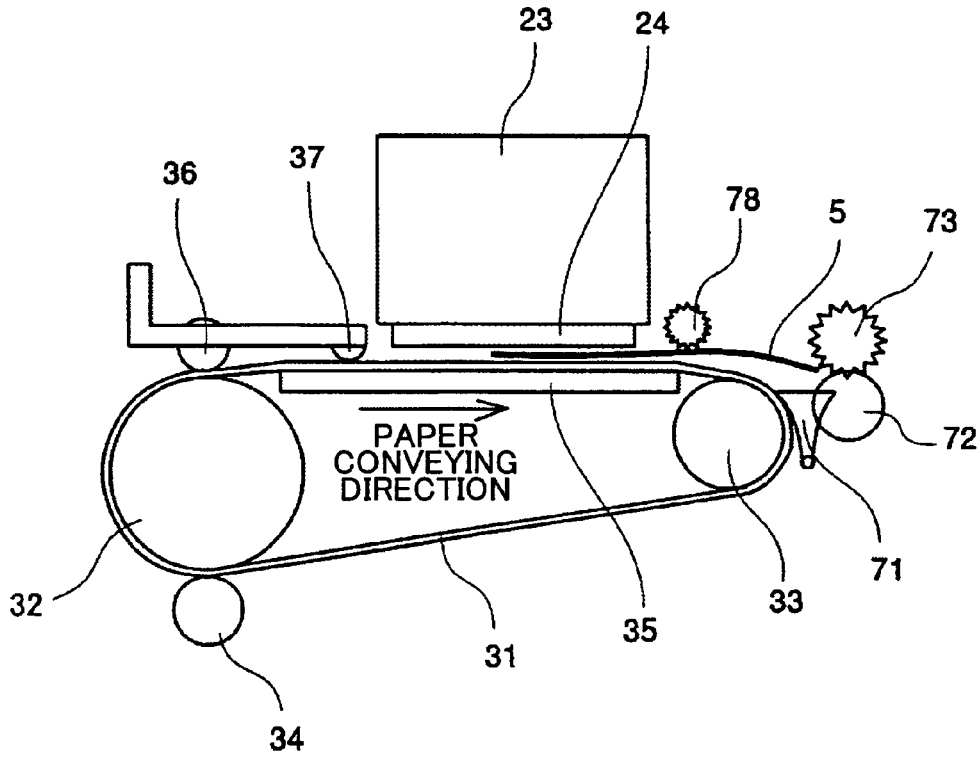
FIG. 14 is a side view of a part of an image forming apparatus according to a variation of the second embodiment.

Moreover, as shown in FIG. 14, the spur 78 as the lift preventing mechanism is preferably located on the upstream side of a separation point at which the paper 5 is separated from the conveyance belt 31 by the separation (a curvature separation point in a case where the separation claw 71 is not used).

That is, the contact of the paper 5 with the carriage due to a lift of the paper 5 is effectively prevented by reducing the lift at a position close to the carriage 23. Thus, by locating the spur 78 at a position on the upstream side of the separation point at which the paper 5 is separated from the conveyance belt 31 by the separation claw 71, the paper is positively prevented from being brought into contact with the carriage 23 due to a lift of the paper 5.

Figure 15:
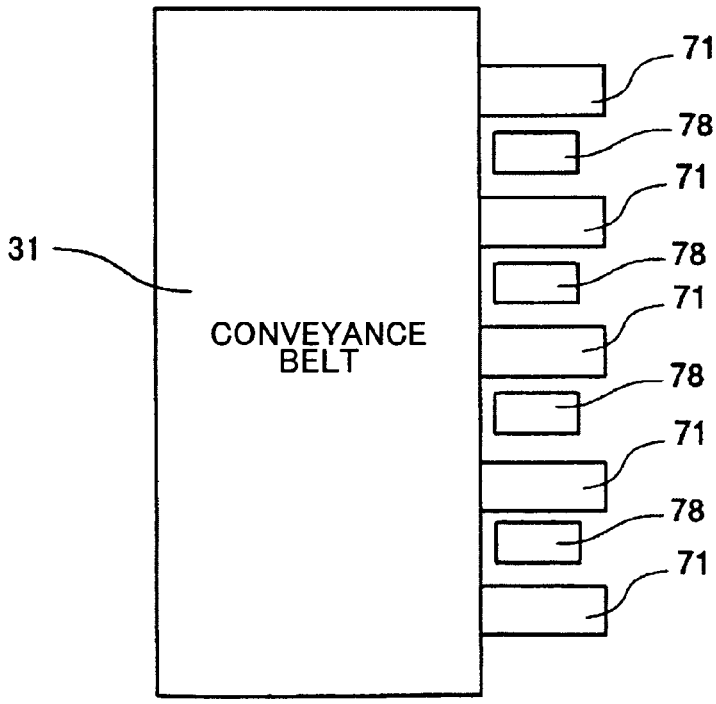
FIG. 15 is an illustration showing arrangement of separation claws and spurs.
Figure 16:
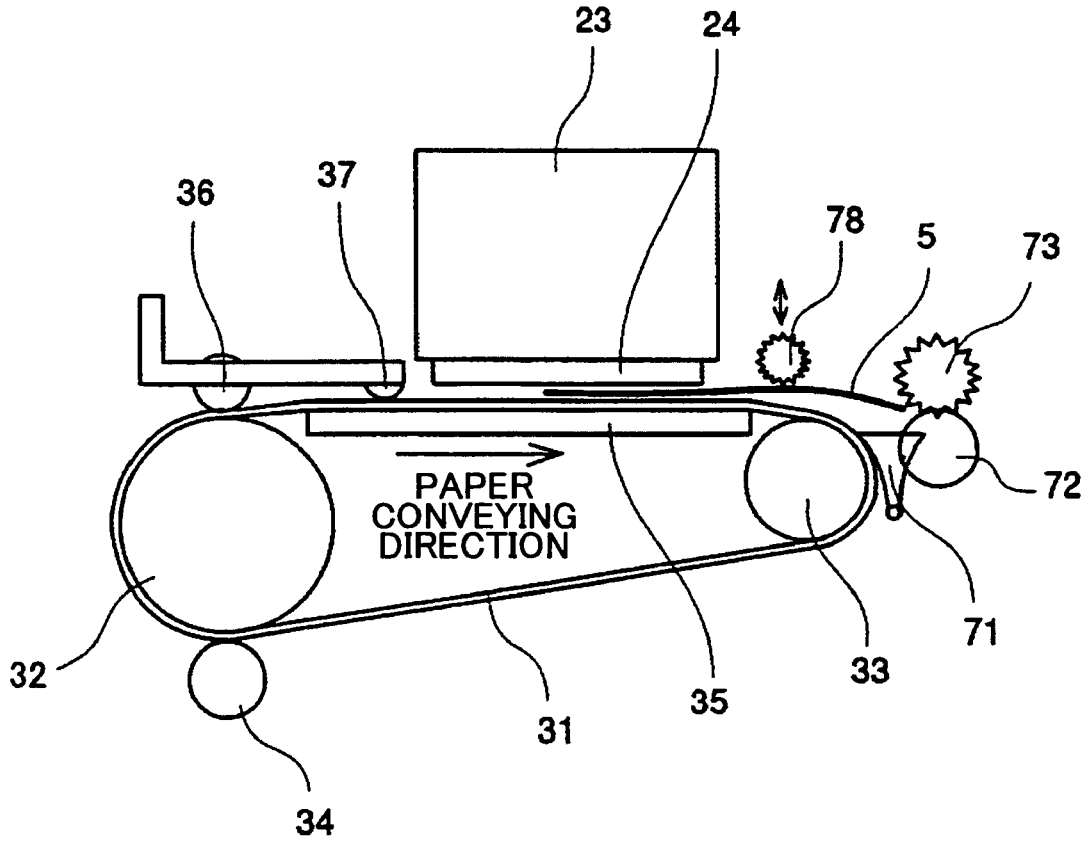
FIG. 16 is a side view of a part of an image forming apparatus according to another variation of the second embodiment.

Furthermore, the separation claw 71 and the spur 78 may be arranged alternately as shown in FIG. 15, or the separation claw 71 and the spur 78 may be arranged in the same position in the main-scanning direction although not shown in the figures.

Moreover, the spur 78 may be located movably upward and downward (in directions approaching and apart away from the paper conveyance path). Thus, in a case where a thick paper is conveyed, the spur can move away from the paper conveyance path, which prevents the thick paper from being blocked by the spur 78. Thus, a lift of the paper can be effectively reduced in the transverse mesh direction conveyance.

The present invention is not limited to the specifically disclosed embodiments, and variations and modifications may be made without departing from the scope of the present invention.

The present application is based on Japanese priority application No. 2004-058289 filed Mar. 3, 2004, the entire contents of which are hereby incorporated herein by reference.

What is claimed is:

1. An image forming apparatus, comprising:

a recording head that discharges droplets of a recording liquid onto a paper so as to form an image;

a belt conveyance mechanism including a conveyance belt that electrostatically attaches the paper and conveys the paper in a direction perpendicular to a carding direction of the paper;

a separating mechanism that separates the paper from said conveyance belt, the separating mechanism including a separating claw contacting said conveyance belt;

a lift preventing mechanism that prevents a lift of the paper being fed out of said belt conveyance mechanism, the lift preventing mechanism including a contacting member that is configured to be brought into contact with the paper being fed out of said belt conveyance mechanism, said contacting member being located close to but separate from said conveyance belt and located in an area directly above the separating claw on an upstream side of a separating point and on a downstream side of said recording head; and a paper eject mechanism located on a downstream side of said separating point, said paper eject mechanism including a paper eject roller and a second spur for holding the paper separated from the conveyance belt therebetween, wherein said contacting member includes a first spur located above and opposite to a part of the conveyance belt where the paper is electrostatically attached thereto, and separate from the paper eject roller, the first spur contacts the paper fed out of said belt conveyance mechanism to reduce a lift of the paper, and the first spur has a diameter smaller than a diameter of the second spur.

2. The image forming apparatus as claimed in claim 1, wherein said contacting member is movable in a direction substantially perpendicular to a direction of conveyance of the paper.

3. The image forming apparatus as claimed in claim 1, wherein said separating mechanism and said lift preventing mechanism are located along the same line perpendicular to a direction of conveyance of the paper by said belt conveyance mechanism.

4. The image forming apparatus as claimed in claim 1, wherein said separating mechanism and said lift preventing mechanism are arranged alternately in the direction perpendicular to the direction of conveyance of the paper.

5. The image forming apparatus as claimed in claim 1, further comprising:

a paper supply mechanism that accommodates the paper to be supplied to said belt conveyance mechanism so that paper is set in said paper supply mechanism in a state where a carding direction of the paper is perpendicular to a direction of conveyance of the paper by said belt conveyance mechanism.

6. The image forming apparatus as claimed in claim 1, wherein said paper supply mechanism is configured and arranged to permit an insertion of the paper so that a direction of the insertion of the paper coincides with a carding direction of the paper.

7. The image forming apparatus as claimed in claim 1, further comprising:

a conveyance roller and an idle roller between which said conveyance belt is provided; and a platen situated under said conveyance belt between said conveyance roller and said idle roller so as to lift said conveyance belt toward said recording head, wherein said conveyance belt is slanted in a slanted portion between said platen and said idle roller and said first spur is located in a vicinity of the slanted portion of said conveyance belt.

* * * * *